US006317909B1

(12) United States Patent
Blum

(10) Patent No.: US 6,317,909 B1
(45) Date of Patent: Nov. 20, 2001

(54) ARISING AID

(76) Inventor: Edward Blum, 44 Main St., Champaign, IL (US) 61801

( * ) Notice: Subject to any disclaimer, the term of this patent is extended or adjusted under 35 U.S.C. 154(b) by 0 days.

(21) Appl. No.: 09/240,356

(22) Filed: Jan. 30, 1999

(51) Int. Cl.[7] ..... A61G 5/14
(52) U.S. Cl. ..... 5/654; 5/655.3; 297/DIG. 10
(58) Field of Search ..... 5/652, 652.1, 652.2, 5/653, 654, 655.3, 710, 713, 715, 708; 297/DIG. 10, 339, 313

(56) References Cited

U.S. PATENT DOCUMENTS

| | | | | |
|---|---|---|---|---|
| 757,477 | | 4/1904 | Friedland . | |
| 1,129,620 | | 2/1915 | Altheide . | |
| 1,168,105 | | 1/1916 | Nyberg . | |
| 3,477,072 | * | 11/1969 | Frost | 5/710 |
| 4,629,162 | * | 12/1986 | Porch+e,uml acu e+ee | 297/DIG. 10 X |
| 4,905,329 | * | 3/1990 | Heilner | 5/654 |
| 4,934,002 | * | 6/1990 | Watanabe | 5/715 X |
| 4,947,500 | * | 8/1990 | Seiler | 5/713 |
| 5,361,433 | * | 11/1994 | Vanzant | 5/654 X |
| 5,375,910 | | 12/1994 | Murphy . | |
| 5,505,518 | | 4/1996 | Pike . | |
| 5,742,957 | * | 4/1998 | Vanzant | 297/DIG. 10 X |
| 5,902,011 | * | 5/1999 | Hand et al. | 5/655.3 X |
| 5,918,936 | * | 7/1999 | Murphy | 297/DIG. 10 X |
| 5,956,787 | * | 9/1999 | James et al. | 5/715 X |
| 5,988,747 | * | 11/1999 | Jeans | 297/DIG. 10 X |

OTHER PUBLICATIONS

Sammons Preston Catalog p. 287 Air Physics Lift Cushion (Date Unknown).

* cited by examiner

*Primary Examiner*—Terry Lee Melius
*Assistant Examiner*—Robert G. Santos

(57) ABSTRACT

An arising aid to allow individuals needing assistance in raising from a seating position to a standing position. When the device is placed on a chair seat, the user may inflate bellows in the device by rocking from side to side. The inflated bellows raise the seated person to a near standing position, where the user may be able to stand without further assistance.

16 Claims, 10 Drawing Sheets

ARISING AID

BACKGROUND OF THE INVENTION

The invention has two pump chambers mounted on two inflating chambers, a person seated on the pump chambers shifting the person's weight alternately from pump chamber to pump chamber to pump air alternately into the one of the inflating chambers from which the person's weight has been shifted away thus helping the person arise to a near standing position. Many people have difficulty arising from chairs because of weakness, pain, balance uncertainties, and other reasons. Part of their problem is that during the intermediate positions between a seated position and a near standing position they are unstable, unable to control their position, and fearful of falling. They need a device which will help them arise to a near standing position, which will provide stable support for the person all through the arising process, and which is fully controlled by the person. One solution to this problem is to provide an inflatable arising aid which is inflated by a pump actuated by a person seated on the pump by shifting their weight from side to side. Shifting one's weight from side to side is an easy for most people even for people with limited strength. The person's weight does the pumping work. The person is securely supported at all stages by the arising device, and the person can fully control the rate of inflation of the arising aid.

DESCRIPTION OF THE PRIOR ART

Various devices which help a person arise from a chair to a near standing position are available, and inflatable devices which help a person arise to a near standing position are shown in prior art. In U.S. Pat. No. 5,375,910 Murphy shows a chair with an in-built device inflated by an external electrically powered pump, and in U.S. Pat. No. 5,505,518 Pike shows a device which can be mounted on a chair and inflated by an external electrically powered pump. The severe problem of controlling the air flow rate is not addressed in either of these devices. Neither of these suggest that the person seated on the chair could actuate a pump by shifting their weight from side to side which solves the problem of controlling the air flow rate and eliminates the external air pump. Special purpose air pumping devices which are actuated on a seat are shown in prior art, but they are not adapted for general use nor for inflating an arising device. In U.S. Pat. No. 1,168,105 Nyberg shows an air pumping device used in an automobile where the pumping action comes from the bouncing motion of the person seated on the device as the automobile moves down a bouncy road. This is not adapted for general use and could not be used by a person to inflate a device to help the person arise as it would be uncomfortable and possibly dangerous for the person to bounce sufficiently on this device to inflate an arising aid. In U.S. Pat. No. 2,664,241 Sunday shows a seat cushion which when sat upon will discharge some air to aerate a bait bucket. Since a person has to arise to actuate this device it could not be used to inflate an arising aid. Neither of these devices suggest that a pump which is actuated by a person seated on the pump shifting their weight from side to side.

Several variations of pumps attached to rocking chairs are shown in prior art; for example, in U.S. Pat. No. 170,308 by Sell, in U.S. Pat. No. 402,026 by Marschall, in U.S. Pat. No. 757,447 by Friedland, and in U.S. Pat. No. 1,129,620 by Altheide. None of these suggest a pump actuated by a person seated on the pump shifting their weight from side to side. A front to back rocking motion is not compatible with the stability and control requirements of an arising device. The mechanical arrangements of these pumps designed for rocking chair pumps can not be used for a pump actuated by a person seated on the pump shifting their weight from side to side.

SUMMARY OF THE INVENTION

Objects of this invention comprise requirements listed in the following imperatives. Make an arising aid which can be inflated to help a person arise to a near standing position. Make an arising aid which securely supports the person throughout the arising process. Make an arising aid which is fully controlled by the person using the device. Make an arising aid with two pump chambers and two inflating chambers, which is actuated by a person seated on the pump chambers by shifting the person's weight from side to side. Pneumatically connect inflating chambers to the pump chambers so that air is pumped into an inflating chamber from which the person's weight has been shifted away. Make the pump and arising aid portable so that the person needing to use the arising aid can put the arising aid in place just before they need to use it.

Other objects will be comprehended in the drawings and detailed description, which will make additional objects obvious hereafter to persons skilled in the art. In summary one embodiment of this invention has a first pump chamber and a second pump chamber, each pump chamber having a one-way-valved inlet port and an outlet port and each pump chamber being biased to extend and inflate when no net external force acts on the chamber, and has a first inflating chamber located under the first pump chamber and a second inflating chamber located under the second pump chamber, each inflating chamber having a one-way-valved inlet port and having a valved outlet port, the second inflating chamber inlet port being pneumatically connected to the first pump chamber outlet port and the first inflating chamber inlet port being pneumatically connected to the second pump chamber outlet port, the inflating chambers being inflated by a person seated on the first pump chamber and on the second pump chamber shifting the person's weight alternately to the first pump chamber and then to the second pump chamber to alternately inflate respectively the second pump chamber and then the first pump chamber and to alternately pump air respectively into the first inflating chamber and into the second inflating chamber until the inflating chambers are inflated enough to help the person arise to a near standing position. Other equivalent embodiments will be comprehended in the drawings and detailed description, which will make additional equivalent embodiments obvious hereafter to persons skilled in the art.

DETAILED DESCRIPTION OF THE DRAWINGS

Figure 1:
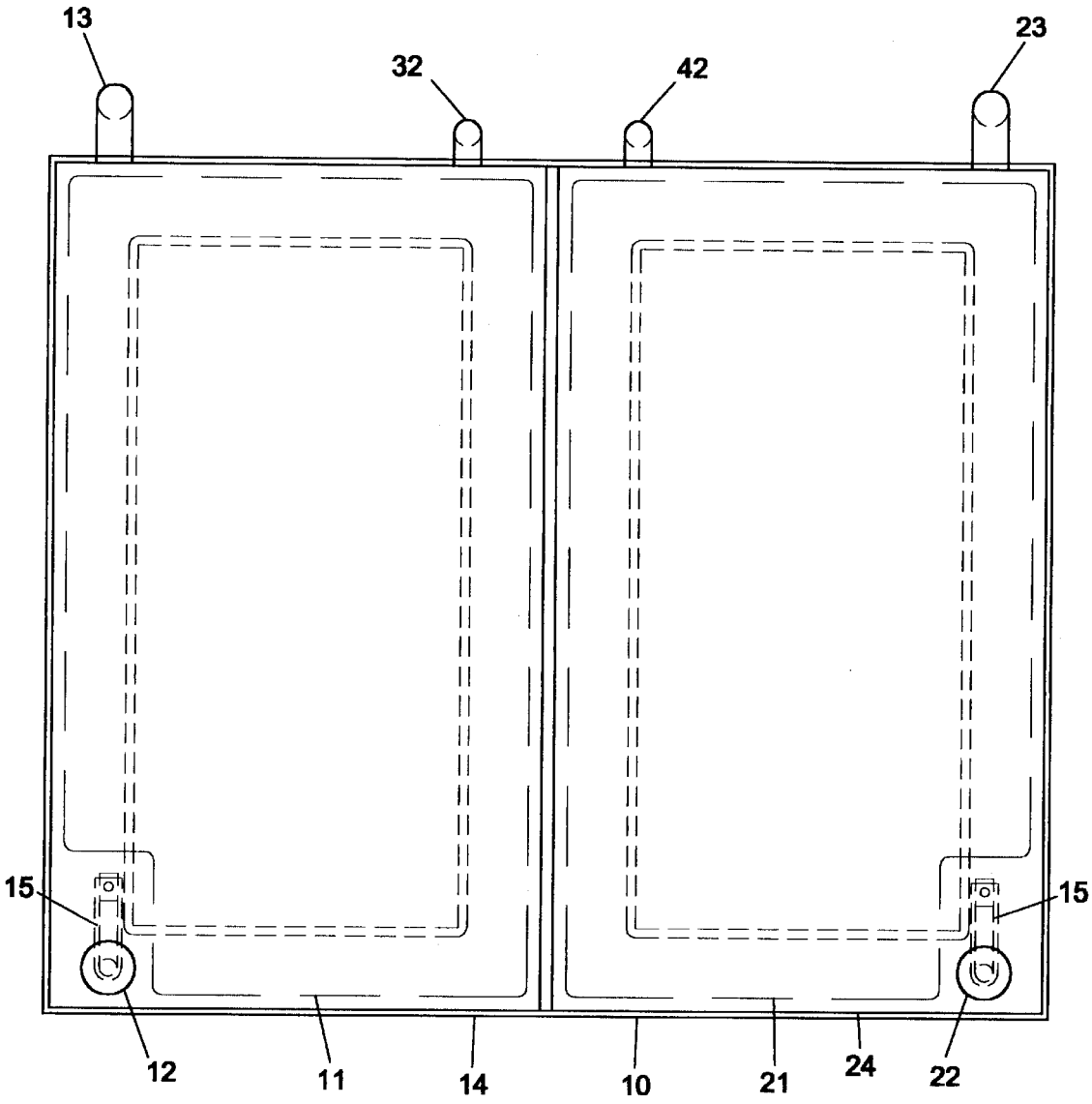
FIG. 1 is a top view of a first embodiment.
Figure 2:
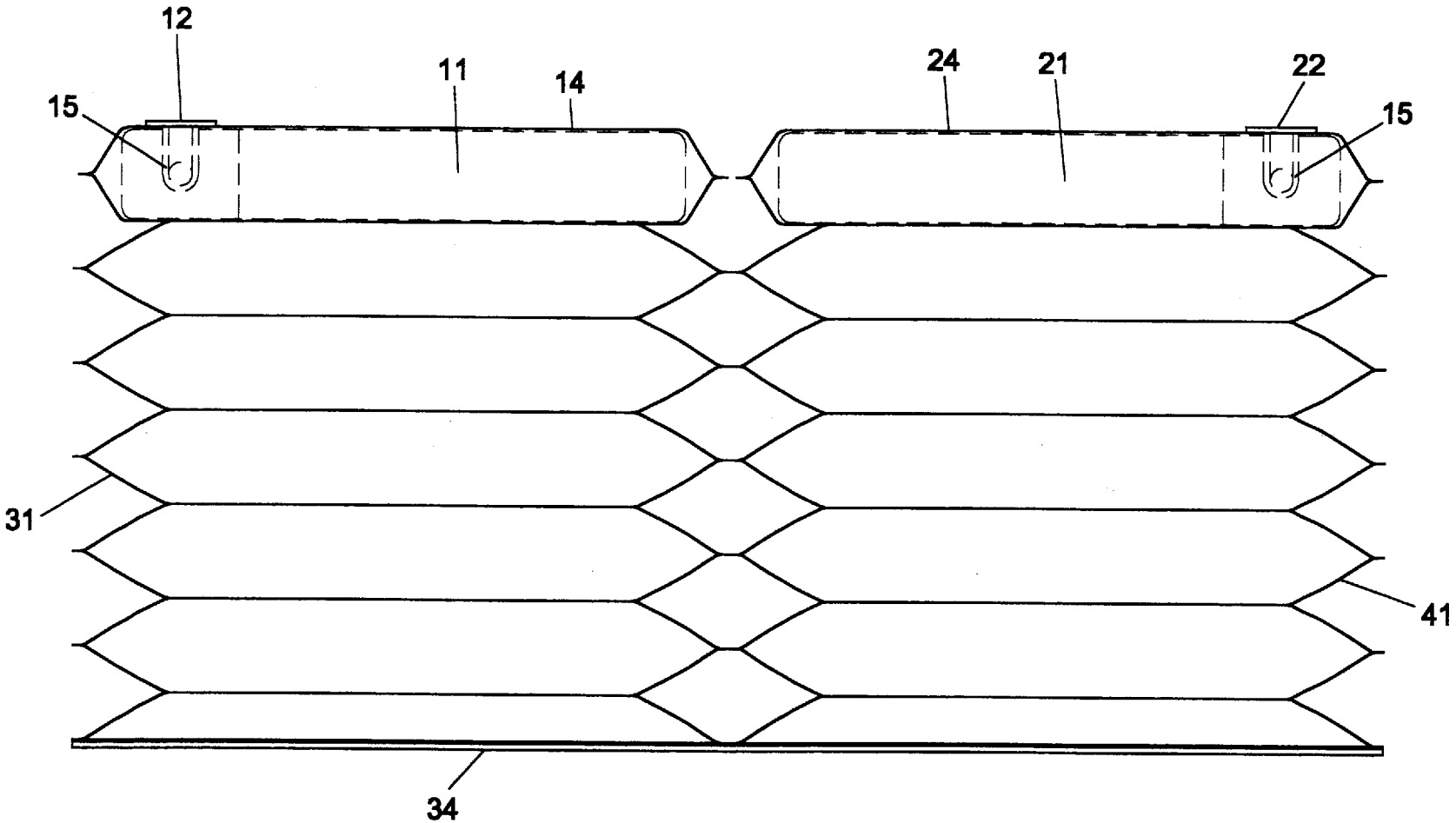
FIG. 2 is a front elevational view of a first embodiment in an expanded position.
Figure 3:
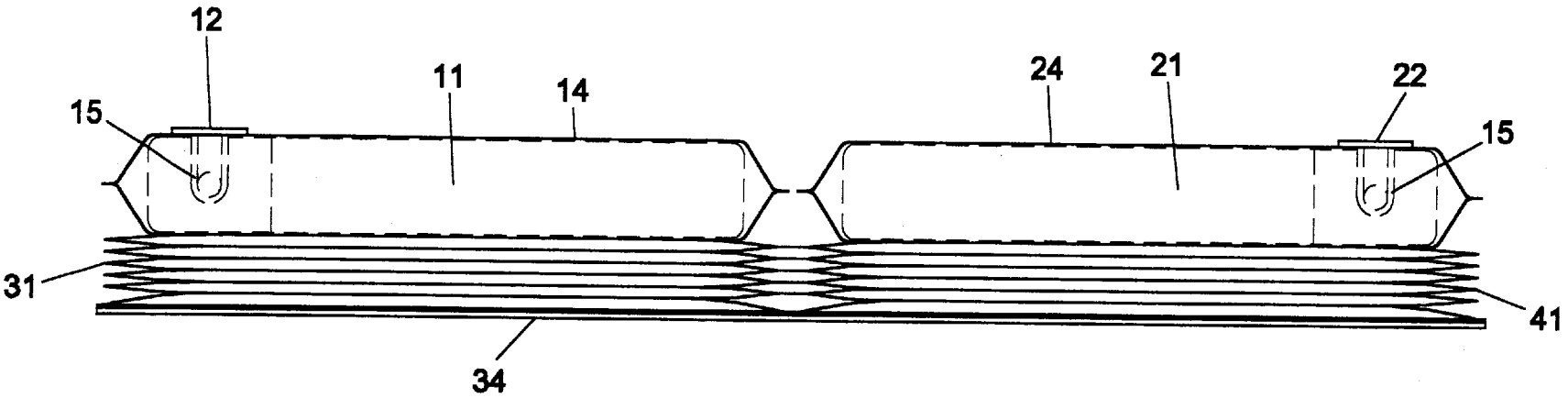
FIG. 3 is a front elevational view of a first embodiment in a collapsed position.
Figure 4:
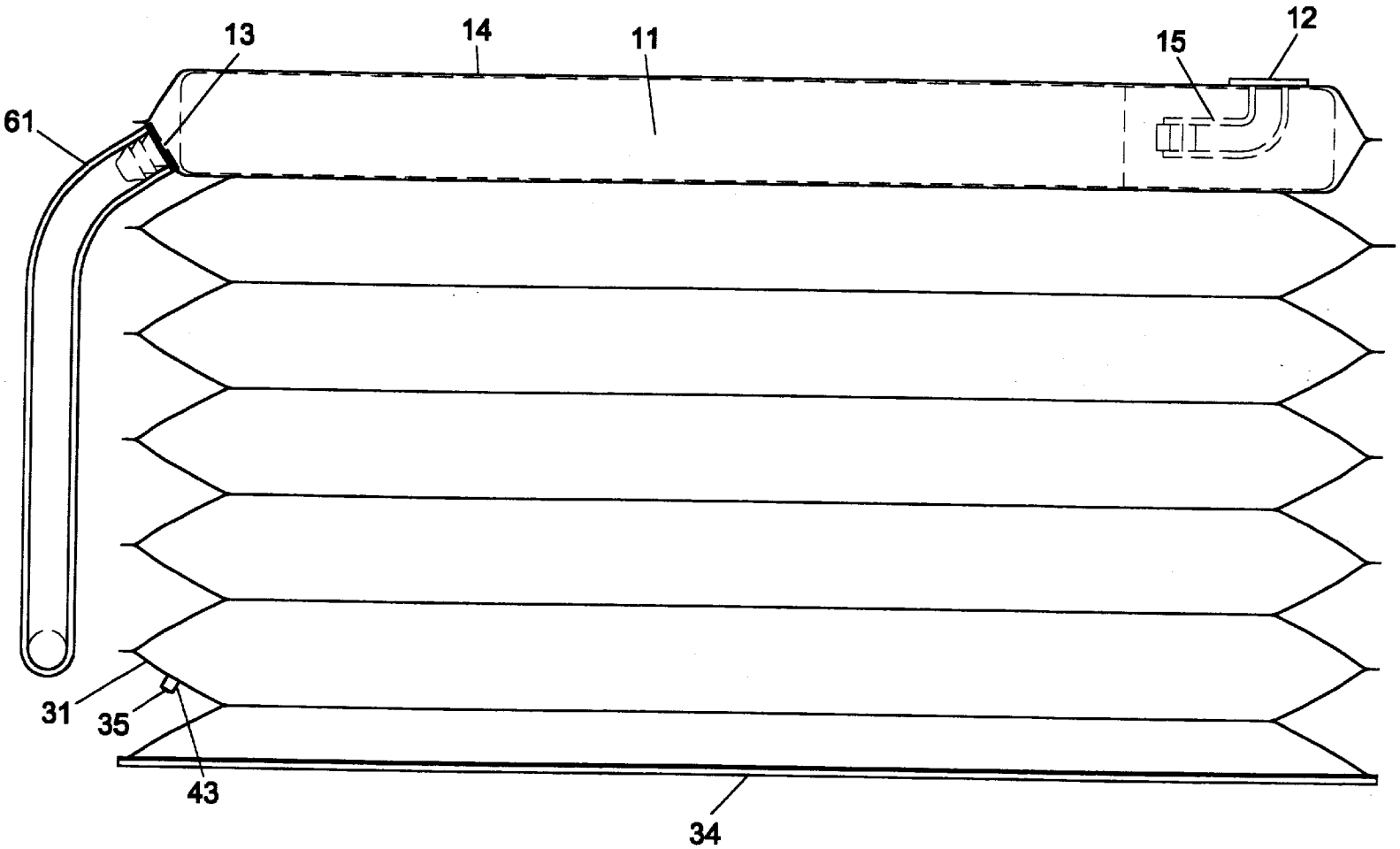
FIG. 4 is a side elevational view of a first embodiment in an expanded position.
Figure 5:
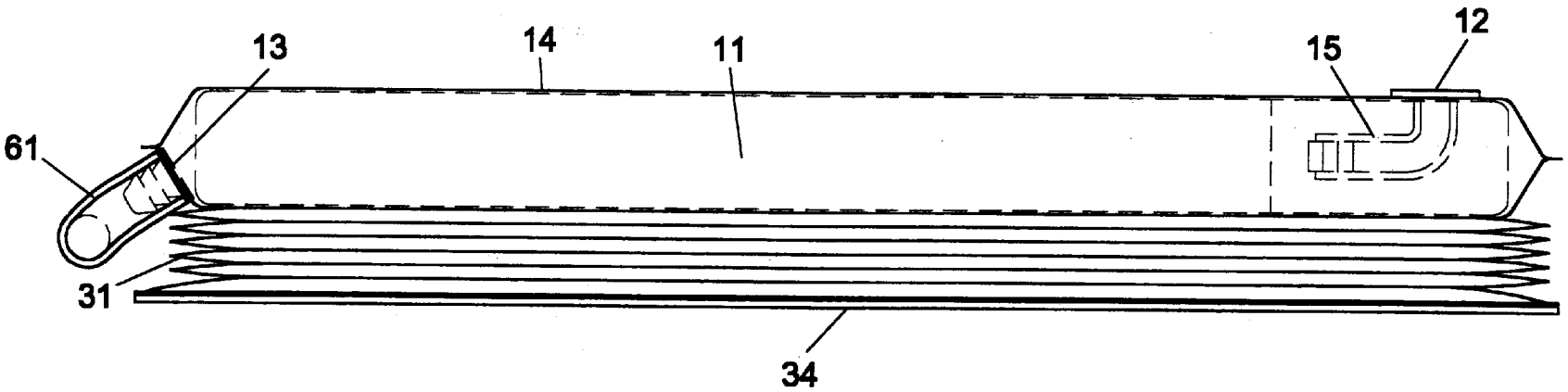
FIG. 5 is a side elevational view of a first embodiment in a collapsed position.
Figure 6:
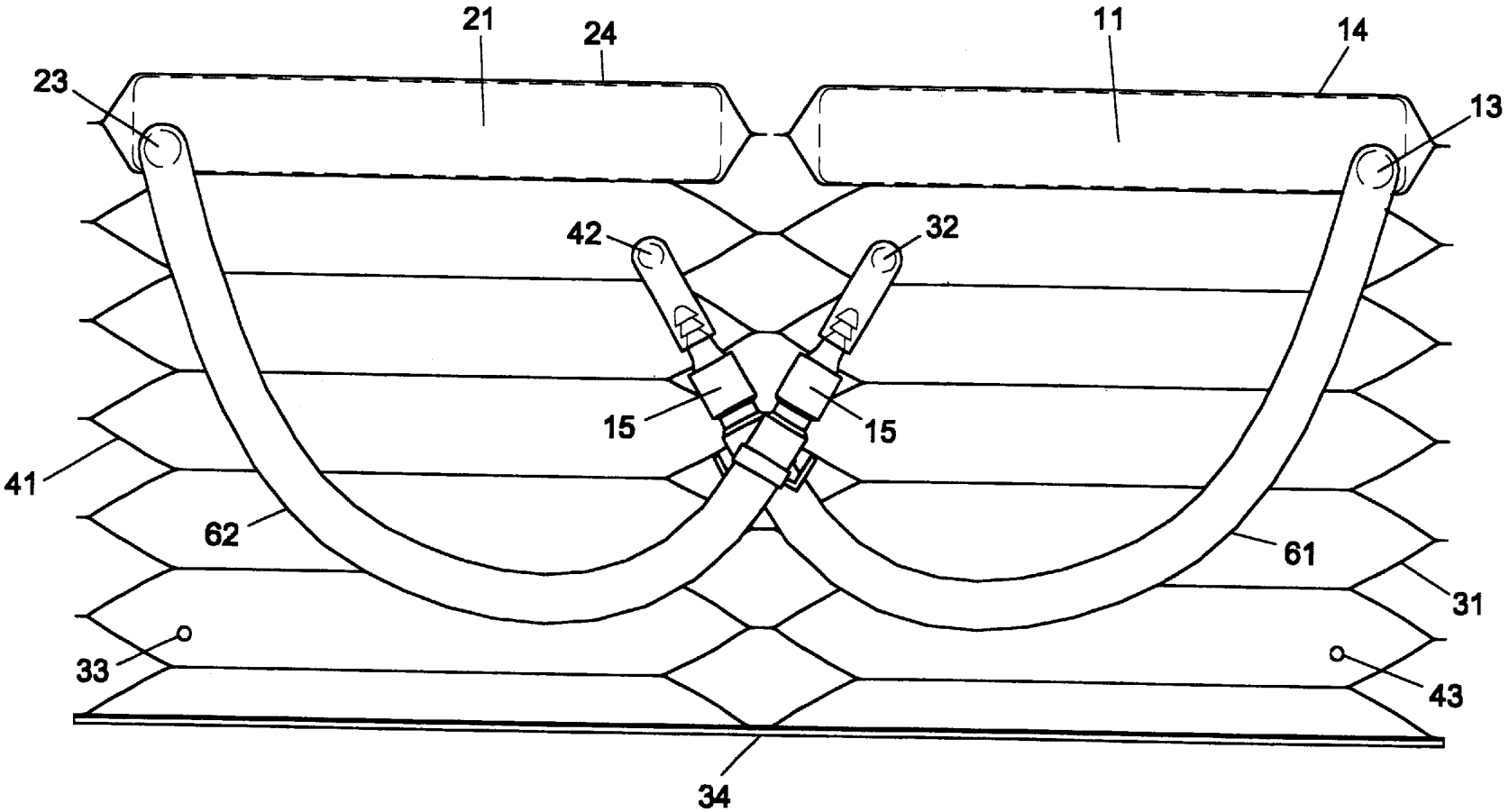
FIG. 6 is a rear elevational view of a first embodiment in an expanded position.
Figure 7:
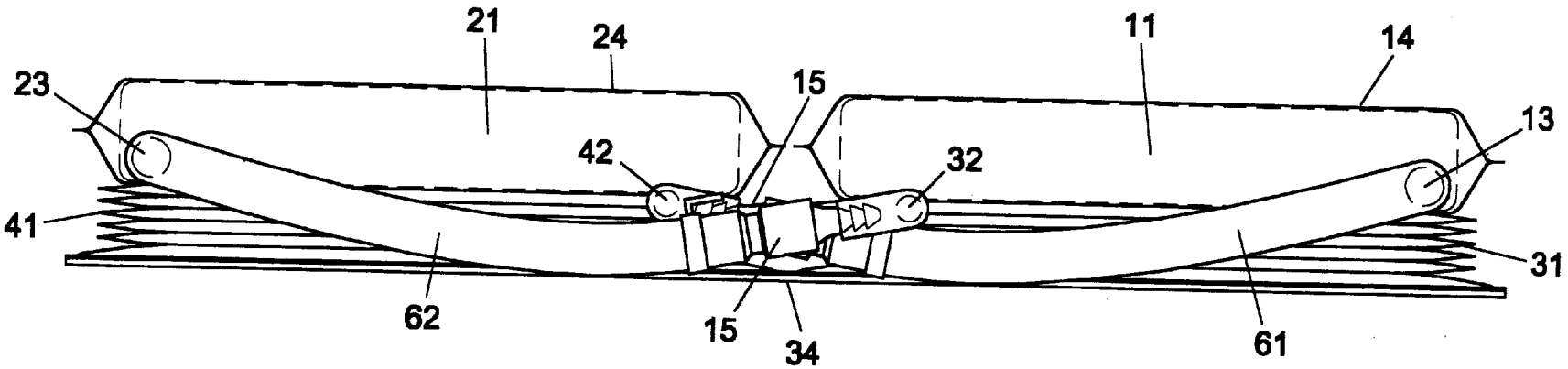
FIG. 7 is a rear elevational view of a first embodiment in a collapsed position.

FIG. 2 is a front view of an embodiment of the invention, an arising aid, showing the pump and inflating chambers of the device separated to show the pneumatic connections. The arising aid is designed to be placed onto a chair (not shown) for aiding a person (not shown) in arising from a sitting position to a standing position. The arising aid contains a left pump chamber 11, a right pump chamber 21, a left inflating chamber 31, and a right inflating chamber 41, each chamber being coupled to one another. The left and right pump chambers 11 and 21, are located vertically above the left and right inflating chambers 31 and 41, respectively. The left and right inflating chambers 31 and 41 may be sealed onto a bottom plate 34 for stability of the arising aid. The left and right pump chambers 11, 21, and the left and right inflating chambers 31, 41 are each constructed of a material that is impervious to air.

The left pump chamber 11 contains at least one inlet port 12 for allowing air to enter the left pump chamber 11, and is also fitted with an outlet port 13 for allowing air to escape from the left pump chamber 11. The inlet port 12 is fitted with a first one-way valve 15. Preferably, the first one-way valve 15 is located inside of the left pump chamber 11. The one-way valve 15 is configured such that air will flow through the tube when pressure from outside of the left pump chamber 11 is greater than the pressure from inside of the chamber, and configured such that air will not flow through the flat tube when the pressure inside the left pump chamber 11 is greater than the pressure from outside of the chamber. One-way valves 15 such as this are well known in the art, and alternate embodiments of one-way valves 15 may be used to achieve the result of the one-way valve of this invention. Preferably, the first one-way valve 15 is located within the left pump chamber 11. This valve allows air to enter through the inlet port 12, and thus inflate the left pump chamber 11, while preventing the air from escaping through the inlet port 12. The left pump chamber 11 is configured to be biased to inflate when no net external force is acting on the chamber. The left pump chamber 11 is constructed of material that is impervious to air. Those skilled in the art will appreciate that the arising aid of the present invention may be made of various air impervious materials that may be used for a chamber that holds air and that is inflatable. Because the left pump chamber 11 is air impervious, fitted with a first one-way valve 15 at the inlet port 12, and biased to inflate when no net external force acts on the chamber, a person (not shown) can inflate the left pump chamber 11 by shifting the person's weight to the opposite (right) side of the arising aid so that the weight of the person is away from the left pump chamber 11. The air can only escape through the outlet port 13 of the left pump chamber 11. In one embodiment, the left pump chamber 11 contains a first top plate 14 sealed onto the top surface of the left pump chamber 11. When a person shifts his weight onto the left pump chamber 11, the weight of the person forces the pump chamber air through the outlet port 13 and into the right inflating chamber 41.

The right inflating chamber 41 contains an inlet port 42 and a sealable outlet port 33. The inlet port 42 of the right inflating chamber 41 is pneumatically connected through a first pneumatic connection 61 to the outlet port 13 of the left pump chamber 11. Preferably, the first pneumatic connection 61 is located outside of the right inflation chamber 41. The inlet port is fitted with a second one-way valve 15 preferably similar to the first one-way valve 15 used for the left pump chamber 11. Preferably, the second one-way valve 15 is located within the right inflating chamber 41. The second one-way valve 15 of the inlet port 42 is configured such that air enters the right inflating chamber 41 through the inlet port 42 when pressure from outside the chamber is greater than the pressure from inside of the chamber, but the air will not escape from the chamber through the inlet port 42 when the pressure inside the chamber is greater than the pressure outside of the chamber. The air entering through the inlet port 42 remains in the right inflating chamber 41, thus inflating the chamber. As the right inflating chamber 41 inflates, it increases the overall height of the arising aid, thereby pushing the person upward. Because the person inflates an inflating chamber on one side by shifting the weight of the person to the opposite side, for example inflating the right inflating chamber 41 by shifting the weight of the person to the left side, the right inflating chamber 41 inflates without pressure from the person's weight opposing the airflow. The outlet port 33 is sealable, preferably by use of a cap valve that is sealed with a cap 35. The right inflating chamber 41 is biased to deflate and collapse when no net external force acts upon the chamber. This is useful for deflating the arising aid 10 after its use simply by unsealing the outlet port 33. In the preferred embodiment, the outlet port 33 would be unsealed by removing the cap 35.

Located directly above the right inflating chamber 41 is the right pump chamber 21. The right pump chamber 21 is designed similarly to the left pump chamber 11. The right pump chamber 21 contains at least one inlet port 22 and an outlet port 23. The inlet port 22 is fitted with a third one-way valve. Preferably, the third one-way valve 15 is located within the right pump chamber 21. The third one-way valve 15 is configured such that air will flow through the one-way valve when pressure from outside the chamber is greater than the pressure from inside the chamber 21, but will not flow through the valve when pressure from inside the chamber is greater than the pressure from outside of the chamber. The right pump chamber 21 is biased to inflate when no net outside force acts on the chamber, causing air to enter through the inlet port 22, inflating the right pump chamber 21 when the weight of the person is shifted away from the right side of the arising aid. In one embodiment, a second top plate 24 is sealed onto the top surface of the right pump chamber 21. When the weight of the person is shifted toward the right side of the arising aid and onto the right pump chamber 21, air is forced from the chamber out through the outlet port 23 and through a second pneumatic connection 62 to an inlet port 32 of the left inflating chamber 31. The second pneumatic connection 62 is similar to the first pneumatic connection 61. Preferably, the second pneumatic connection is located outside of the left inflating chamber 31.

The left inflating chamber 31, located directly underneath the left pump chamber 11, is similar to the right inflating chamber 41. The left inflating chamber 31 contains an inlet port 32 and a sealable outlet port 33. The inlet port 32 is fitted with a fourth one-way valve 15 which preferably is similar to the one-way valves fitted to the other inlet ports of the arising aid. Preferably, the fourth one-way valve 15 is located within the left inflating chamber 31. The sealable outlet port 33 is similar to the outlet port 43 of the right inflating chamber 41, and preferably will be sealed with a cap valve, fitted with a cap 35. The left inflating chamber 31 will receive air from the right pump chamber 21, inflating the left inflating chamber 31 and increasing the height of the arising aid, thereby pushing the person upward.

Figure 8:
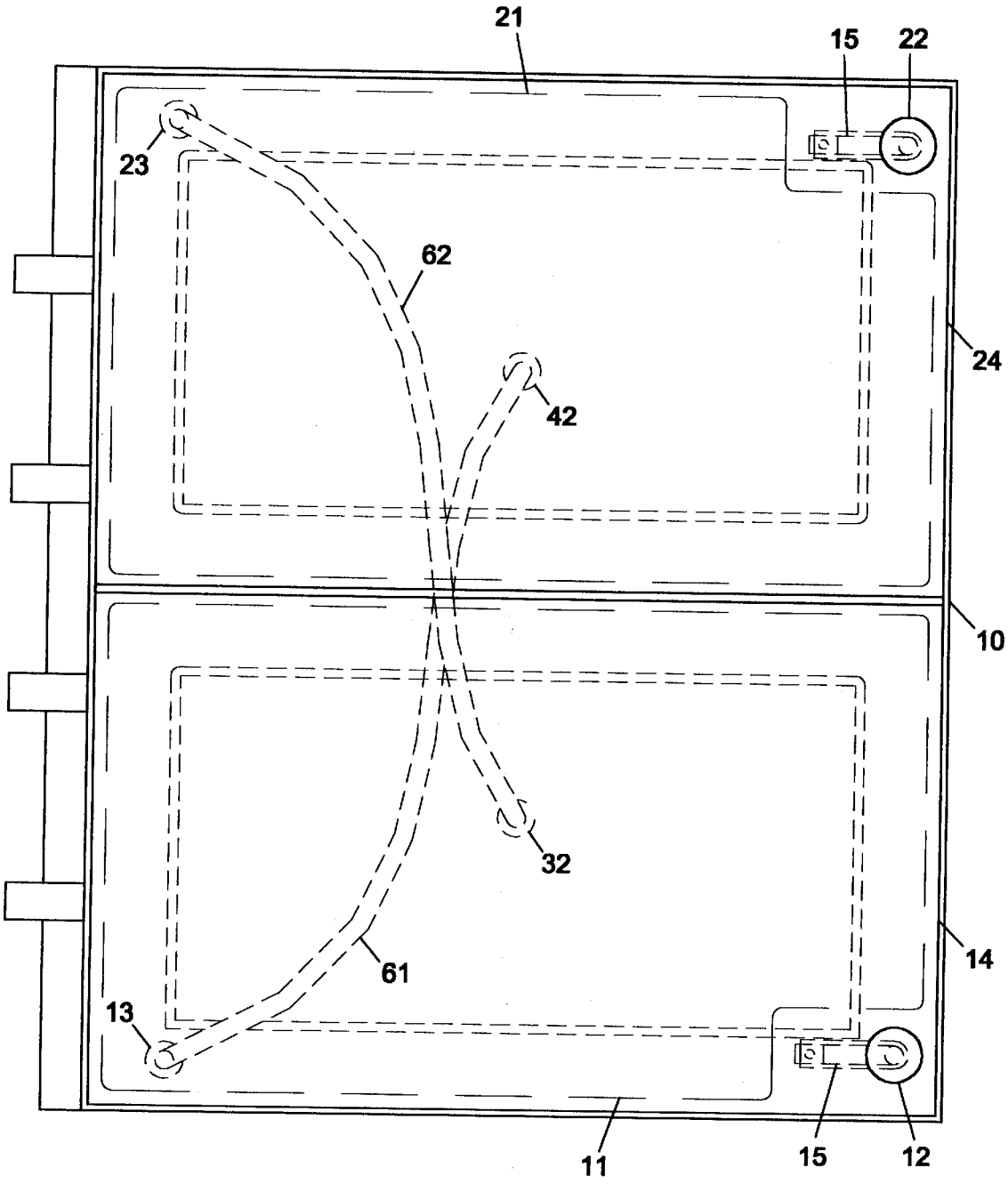
FIG. 8 is a top view of a second embodiment in a clam shell shape.
Figure 9:
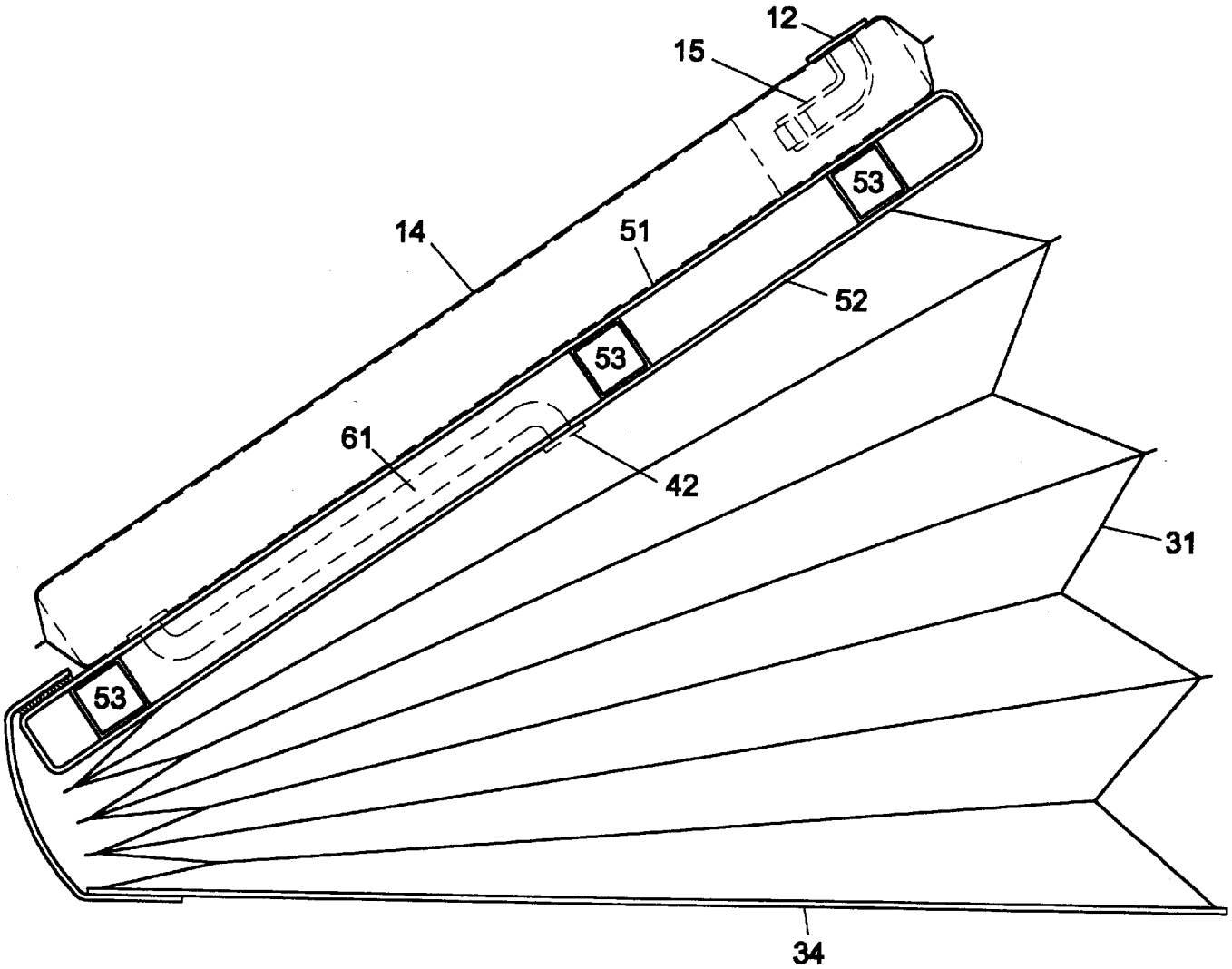
FIG. 9 is a side elevational view of a second embodiment in a clam shell shape in an expanded position.
Figure 10:
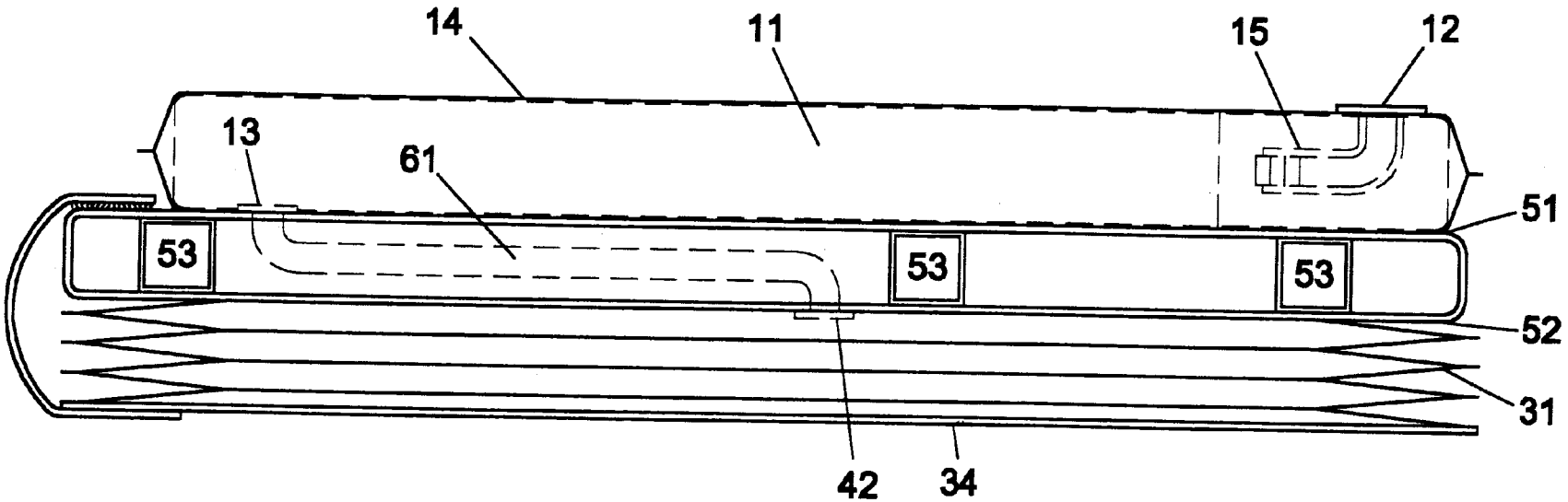
FIG. 10 is a side elevational view of a second embodiment in a clam shell shape in a collapsed position.

Repeated shifting from side to side by the person will result in the inflating chambers 31 and 41 inflating sufficiently to push the person upward and out of the chair. By using the arising aid of the present invention, the person is able to cause the arising aid to arise evenly, and at a controlled air flow rate, which provides stability and secure support for the person as the person arises. The weight of the person acts to control the arising aid, and therefore no motors are needed for the device to operate. Generally, it is much easier for a person to shift the person's weight from side to side than to arise unaided from a sitting position, and therefore, the present invention will aid many in arising from a sitting position to a standing position. The arising aid is simple to use, and the lightweight construction and compactness of the device, combined with the ability to deflate the device, make the device portable.

in one embodiment of the invention, as illustrated in FIGS. 8–10 a first separating plate 51 is sealed to and underneath of the bottom surface of both of the pump chambers 11 and 21. The first separating plate 51 may be penetrated by the inlet ports 12, 22 and the outlet ports 13, 23 of the pump chambers 11, 21. A second separating plate 52 is sealed to and over top of the upper surface of the left inflating chamber 31 and the right inflating chamber 41. The second separating plate 52 may be penetrated by the inlet ports 32, 42 and the outlet ports 33, 43 of the inflating chambers 31, 41. A plurality of separators 53, such as stand off connectors, are coupled to the lower surface of the first separating plate 51 and to the upper surface of the second separating plate 52. The separators 53 are positioned to keep the first and second separating plates 51, 52 separated. In this embodiment, air may freely flow through the pneumatic connections 61, 62 between the pump and inflating chambers without pressure from the pump chambers due to the weight of the person.

In an alternate embodiment, illustrated in FIGS. 1–7, the first and second separating plates 51, 52 are sealed together. The pneumatic connections 61 and 62 comprise air channels that run within the first and second separating plates 51, 52 for allowing air to pass through the channels from the pump chambers 11, 21 to the inflating chambers 31, 41, without escaping through the sealed plates. The pump chamber inlet ports 12, 22 are located away from the separating plates for allowing air to enter the inlet ports. The inflating chamber outlet ports 33, 43 are located away from the separating plates for easier unsealing of the outlet ports 33, 43 for release of air. The sealed first and second separating plates 51, 52 may be joined with the bottom plate 34 using one or more hinges at the end of each plate that is closest to the front of the chair such that the inflation of the inflating chambers 31, 41 will cause the sealed first and second separating plates 51, 52 to rotate about an axis formed by the hinge. The person sitting on this device would be pushed toward the front of the chair as well as upward, for easier raising to a standing position.

The foregoing description of a preferred embodiment of the invention has been presented for purposes of illustration and description, and is not intended to be exhaustive or to limit the invention to the precise form disclosed. The description was selected to best explain the principles of the invention and practical application of these principals to enable others skilled in the art to best utilize the invention in various embodiments and various modifications as are suited to the particular use contemplated. It is intended that the scope of the invention not be limited by the specification, but be defined by the claims set forth below.

I claim:

1. An apparatus that is placed onto a seat for aiding a person in raising from a sitting position to a standing position, the apparatus comprising:

a) a left pump chamber having an inlet port and an outlet port, the left pump chamber being constructed of a material impervious to air, the left pump chamber being biased to inflate;

b) a first one-way valve connected to the inlet port of the left pump chamber;

c) a right inflating chamber having a sealable outlet port and an inlet port, the inlet port of the right inflating chamber being pneumatically connected to the outlet port of the left pump chamber for receiving air from the left pump chamber, the right inflating chamber being constructed of a material impervious to air;

d) a second one-way valve connected to the inlet port of the right inflating chamber;

e) a right pump chamber coupled to and on top of the right inflating chamber, the right pump chamber having an inlet port and an outlet port, the right pump chamber being constructed of a material impervious to air, the right pump chamber being biased to inflate;

f) a third one-way valve connected to the inlet port of the right inflating chamber;

g) a left inflating chamber coupled to and underneath of the left pump chamber, the left inflating chamber having a sealable outlet port and an inlet port, the inlet port of the left inflating chamber being pneumatically connected to the outlet port of the right pump chamber for receiving air from the right pump chamber, the left inflating chamber being constructed of a material impervious to air; and h) a fourth one-way valve connected to the inlet port of the left inflating chamber.

2. The apparatus of claim 1, further comprising a bottom plate sealed underneath the right inflating chamber and the left inflating chamber.

3. The apparatus of claim 1, further comprising: a first top plate sealed onto the left pump chamber; and a second top plate sealed onto the right pump chamber.

4. The apparatus of claim 1, further comprising a first separating plate sealed underneath of the left pump chamber and underneath of the right pump chamber.

5. The apparatus of claim 1, further comprising: a first pneumatic connector which connects the outlet port of the left pump chamber to the inlet port of the right inflating chamber; and a second pneumatic connector which connects the outlet port of the right pump chamber to the inlet port of the left inflating chamber.

6. The apparatus of claim 5, wherein the first pneumatic connector and the second pneumatic connector each penetrate the first separating plate.

7. The apparatus of claim 5, further comprising a second separating plate sealed on top of the left inflating chamber and on top of the right inflating chamber.

8. The apparatus of claim 7, wherein the inlet port of the left inflating chamber and the inlet port of the right inflating chamber each penetrate the second separating plate.

9. The apparatus of claim 7, wherein the first pneumatic connector and the second pneumatic connector each penetrate the second separating plate.

10. The apparatus of claim 7, further comprising a plurality of separators coupled to the underside of the first separating plate and to the topside of the second separating plate for separating the first and second separating plates.

11. The apparatus of claim 1, further comprising a pair of caps, wherein the sealable outlet port of the right inflating chamber and the sealable outlet port of the left inflating chamber are each fitted with one of the pair of caps.

12. A method of raising a person from a sitting position towards a standing position with the assistance of an arising aid which is placed upon a seat, the method comprising the steps of:

a) inflating a left pump chamber;

b) compressing the left pump chamber to force air from the left pump chamber into a right inflating chamber through a pneumatic connection having a one-way valve, whereby the right inflating chamber is inflated and the person is raised;

c) inflating a right pump chamber;

d) compressing the right pump chamber to force air from the right pump chamber into a left inflating chamber through a pneumatic connection having a one-way valve, whereby the left inflating chamber is inflated and the person is raised;

e) repeating steps a) and b) until the left inflating chamber and the right inflating chamber are inflated sufficiently to allow the person to stand.

13. The method of claim 12, comprising the additional steps of: before step a), sealing an outlet port of the right inflating chamber and sealing an outlet port of the left inflating chamber.

14. An apparatus that is placed onto a seat for aiding a person is raising from a sitting position to a standing position, the apparatus comprising:

a) a top planar member having a front end, a back end, and a top surface;

b) a bottom planar member having a front end, a back end, and a top surface, the front end of the bottom planar member being hinged to the front end of the top planar member;

c) a left pump chamber coupled to the top surface of the top planar member, the left pump chamber having an inlet port and an outlet port;

d) a first one-way valve fitted to the inlet port of the left pump chamber;

e) a right pump chamber coupled to the top surface of the top planar member, the right pump chamber having an inlet port and an outlet port;

f) a second one-way valve fitted to the inlet port of the right pump chamber;

g) a right inflating chamber coupled to the top surface of the bottom planar member, the right inflating chamber having an inlet port and an outlet port, the inlet port of the right inflating chamber being pneumatically connected to the outlet port of the left pump chamber;

h) a third one-way valve fitted to the inlet port of the right inflating chamber;

i) a left inflating chamber coupled to the top surface of the bottom planar member, the left inflating chamber having an inlet port and an outlet port, the inlet port of the left inflating chamber being pneumatically connected to the outlet port of the right pump chamber; and j) a one-way valve fitted to the inlet port of the left inflating chamber;

whereby the weight of the person onto the left pump chamber will force air into the right inflating chamber, inflating the right inflating chamber, whereby the weight of the person onto the right pump chamber will force air into the left inflating chamber, inflating the left inflating chamber, whereby the person shifting from right to left repeatedly will inflate the right and left inflating chamber, thereby forcing the top planar member to rotate away from the bottom planar member, forcing the person towards a standing position.

15. The apparatus of claim 14, further comprising: a first pneumatic connector which pneumatically connects the outlet port of the left pump chamber to the inlet port of the right inflating chamber; and a second pneumatic connector which pneumatically connects the outlet port of the right pump chamber to the inlet port of the left inflating chamber.

16. The apparatus of claim 15, wherein the first pneumatic connector comprises a first channel, and the second pneumatic connector comprises a second channel, the first and second channels being located within the top planar member.

* * * * *